US007527524B1

(12) United States Patent
Coleman et al.

(10) Patent No.: US 7,527,524 B1
(45) Date of Patent: May 5, 2009

(54) TOOL-LESS COMPRESSION CONNECTOR FOR COAXIAL CABLES

(75) Inventors: David Coleman, Pleasant Prairie, WI (US); Stephen Paul Sterling, Kenosha, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/166,014

(22) Filed: Jul. 1, 2008

(51) Int. Cl.
*H01R 9/05* (2006.01)

(52) U.S. Cl. ..... 439/578; 439/583

(58) Field of Classification Search ..... 439/578, 439/579, 583, 584, 675
See application file for complete search history.

(56) References Cited

U.S. PATENT DOCUMENTS 6,293,004 B1 9/2001 Holliday
6,671,944 B2 1/2004 Holliday et al.
7,147,509 B1 * 12/2006 Burris et al. ..... 439/578
7,188,507 B2 3/2007 Holliday et al.
2007/0251085 A1 11/2007 Holliday et al.
2007/0298654 A1 12/2007 Holliday

* cited by examiner

*Primary Examiner*—Khiem Nguyen
(74) *Attorney, Agent, or Firm*—Husch Blackwell Sanders Welsh & Katz

(57) ABSTRACT

A connector includes a barrel defining a cavity. A front portion is configured to removably mate with the barrel. An electrically conductive elongated pin is positioned in the opening of the front portion and the cavity of the barrel. The pin extends through a distal end of the front portion, and the pin includes a back end for mating with an electrically conductive element. A grasping device defines an aperture therethrough for receiving the electrical element. The grasping device is disposed within the cavity of the barrel. The grasping device is in an engaged position when the barrel and the front portion are coupled for holding the electrically conductive element positioned within the aperture, and the grasping device is in a disengaged position when the barrel and the front portion are uncoupled.

20 Claims, 5 Drawing Sheets

TOOL-LESS COMPRESSION CONNECTOR FOR COAXIAL CABLES

FIELD OF THE INVENTION

The present invention relates to electrical connectors, and more particularly, relates to electrical connectors for removably coupling electrically conductive elements.

BACKGROUND OF THE INVENTION

Common electrical connectors or fittings are used to attach to wires in order to connect the wire to various devices or outlets. In the case of coaxial cable and other similar type cables, cable tools are used for stripping outer layers away from an end of the cable before connecting a fitting to the exposed end of the cable. The same or other tools may be used for crimping or otherwise fastening the fitting to the cable end so that the cable can connect to an appropriate cable ready device or wall connector. However, often a separate tool must be carried by the technician to fasten the cable to the cable fitting. A variety of cable fittings are available, and each may require separate tools for making a proper connection between the cable and the cable fitting. The additional tools add to the cost of installation and require more time for the technician to connect the cable and the cable fitting. Another disadvantage of known fittings or connectors includes additional cost of replacing connectors, for example, when a cable fitting did not attached correctly or a new end to the cable needs to be made. In this case, another cable fitting is attached and the old one is discarded. The one time use of the cable fittings adds to the cost of installation and preparation of the cables. Another disadvantage with prior art devices is in ascertaining when a positive connection is made between the cable fitting and the cable. Frequently, a positive connection is not achieved and the fitting must be removed and another connection made with a new fitting. Further, the false connection may not be recognized until after a test of the cable is made by observing if the connected component works. This results in lost time for the installation technician and loss of the cable fitting.

It would therefore be desirable to provide a device for connecting electrical wires to a device or outlet wherein the cable and the cable fitting is easy to use and requires no additional tools. It would also be desirable to provide a connection device which is easily removable, e.g., requiring no additional tools for removal and also is reusable. Further, there is a need for a connection device which allows the technician to readily ascertain whether a positive connection is made between the electrical wire and device or outlet.

SUMMARY OF THE INVENTION

An electrical connector includes a rear portion defining a cavity therein. The rear portion has a rear opening and a front opening communicating with the cavity. A front portion is configured to removably mate with the rear portion. The front portion defines a cavity having a rear opening and a front opening communicating with the cavity opening. The front and rear portions have a closed position and an open position. An electically conductive elongated pin is moveably positioned in the cavity of the front portion and the cavity of the rear portion. The pin extends through the front opening of the front portion and the pin includes a back end for mating with an electrically conductive element. A grasping device defines an aperture therethrough having a diameter. The grasping device is disposed within the cavity of the rear portion and the cavity of the front portion. The grasping device is coupled to the front portion adjacent the rear opening in the front portion. The grasping device is engaged for gripping the electrically conductive element positioned within the front portion cavity and the rear portion cavity when the rear portion and the front portion are in the closed position. The grasping device is disengaged for releasing the electrically conductive element when the rear portion and the front portion are in the open position.

In a related aspect, when the rear and front portions are closed, the engaged grasping device contacts the rear portion for narrowing the aperture in the grasping device. In another aspect, the grasping device has an at-rest diameter when the grasping device is disengaged, and a second diameter when the grasping device is engaged. In a further aspect, the electrically conductive element is passed through the rear and front openings of the rear portion and the aperture in the grasping device, the grasping device resiliently grips the electrically conductive element when the rear portion and the front portion are closed, and the grasping device releases the electrically conductive element when the rear portion and the front portion are opened. The grasping device may be resiliently flexible. The grasping device may be resiliently compressed when contacting the rear portion for narrowing the aperture in the grasping device when the rear and front portions are in the closed position. Further, the grasping device may be plastic. The grasping device may be resiliently compressed when contacting an angled inner wall of the rear portion narrowing the aperture in the grasping device when the rear and front portions are in the closed position. The grasping device may define slits allowing the grasping device to be resiliently compressed when contacting the rear portion. The electrically conductive elongated pin may include a recessed area at the back end for mating with the electrically conductive element. The grasping device may include ridges for holding an electrical cable in the aperture when the grasping device is engaged. The rear portion may include internal threads mating with external threads on the front portion. The pin may be moveable within the cavity of the front portion and the cavity of the rear portion to moveably mate with the electrically conductive element. The pin may be movable within the cavities of the front and rear portions and reciprocates motion with the electrical conductive element mating with the pin. The grasping device may be a resilient plastic ring defining slits allowing compression of the ring, and the ring returning to its original state when uncompressed.

In another related aspect, the connector may further include a first indicator viewable from the outside of the front portion for indicating when the grasping device is in the disengaged position. The connector may further include a second indicator viewable from the outside of the front portion for indicating when the front and rear portions are not closed. The grasping device may incrementally grip the electrically conductive element as the front and rear portions move from the open position to the closed position.

In another aspect, a method for connecting electrical elements comprises: providing a rear portion defining a cavity therein, the rear portion having a rear opening and a front opening communicating with the cavity; providing a front portion configured to removably mate with the rear portion, the front portion defining a cavity having a rear opening and a front opening communicating with the cavity opening; positioning an electrically conductive elongated pin in the cavity of the front portion and the cavity of the rear portion, the pin extending through the front portion; coupling a back end of the pin with an electrically conductive element; providing a grasping device defining an aperture therethrough having a diameter; positioning the grasping device within the cavity of the rear portion and the cavity of the front portion; closing the rear portion and the front portion for moving the grasping device into an engaged position for gripping the electrically conductive element positioned within the front portion cavity and the rear portion cavity; and opening the rear portion and the front portion for moving the grasping device into a disengaged position for releasing the electrically conductive element positioned within the front portion cavity and the rear portion cavity.

In a related aspect, the method further includes the grasping device contacting an angled inner wall of the rear portion for incrementally compressing the grasping device as the rear portion and the front portion are closed.

BRIEF DESCRIPTION OF THE DRAWINGS

These and other objects, features and advantages of the present invention will become apparent from the following detailed description of illustrative embodiments thereof which is to be read in connection with the accompanying drawings, in which.

DETAILED DESCRIPTION OF THE INVENTION

Figure 1:
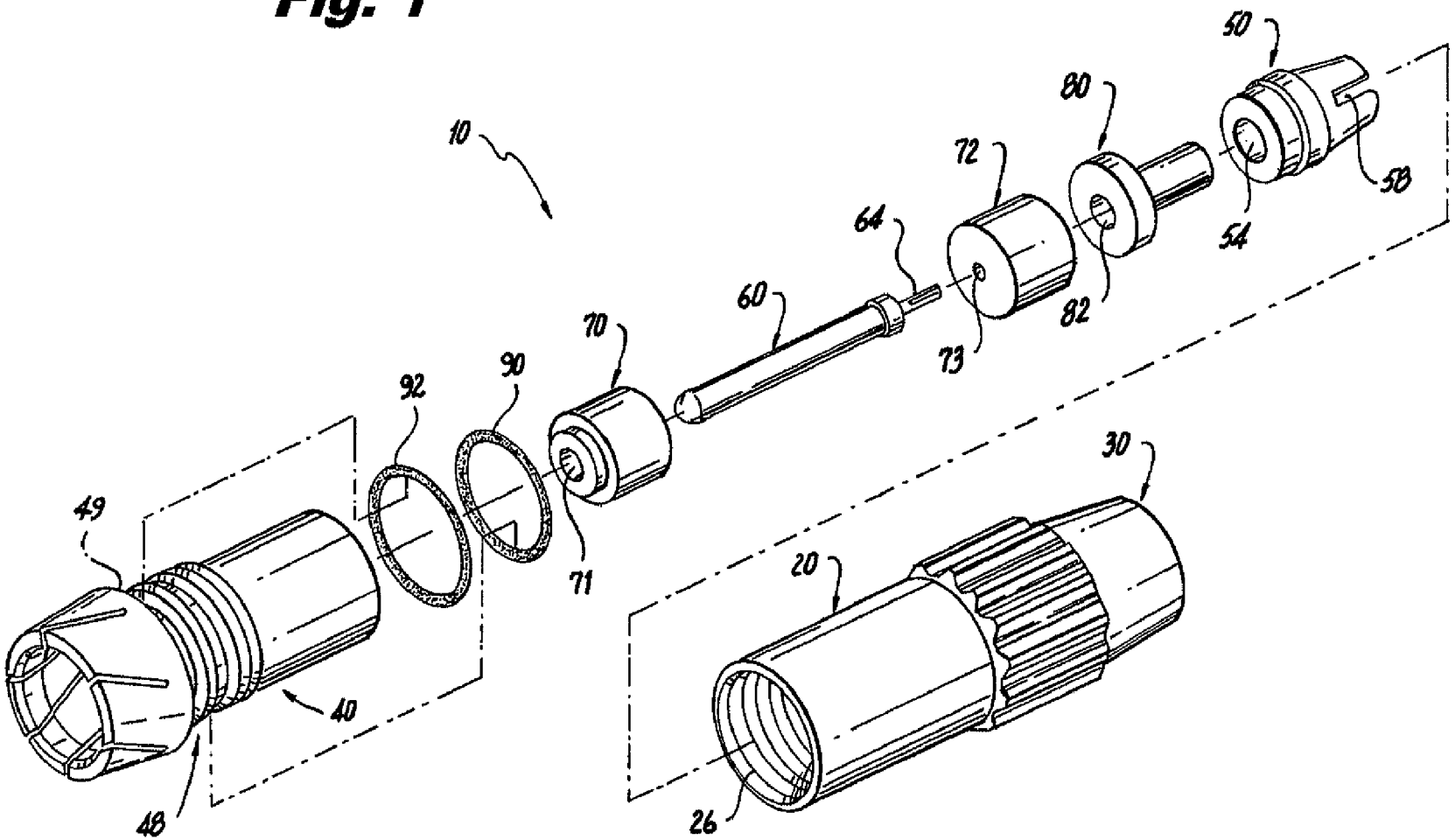
FIG. 1 is a exploded perspective view of an electrical connector according to an embodiment of the present invention including a front portion, a pin, a grasping ring, and a barrel portion.
Figure 2:
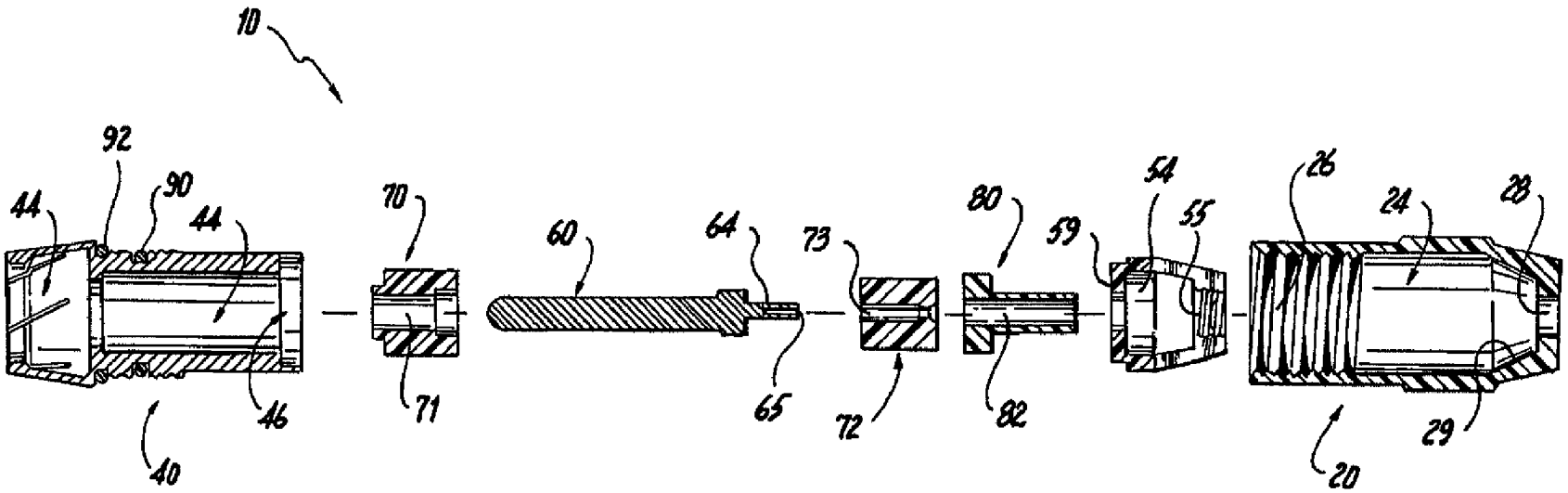
FIG. 2 is a cross-sectional exploded perspective view of the electrical connector shown in FIG. 1.

FIGS. 1 and 2 illustrate one embodiment of a connector 10 for connecting an electrically conductive element to a wire. The connector 10 includes a rear portion embodied as a barrel 20 defining a cavity 24 therein, and the barrel 20 defines a hole 28 extending through a back wall 30 and communicating with the cavity 24. The barrel 20 includes internal threads 26 and an internal angled wall 29 toward the back of the barrel 20.

Additionally, the connector 10 includes a front portion 40 which is configured to removably mate with the barrel 20. The front portion 40 includes an opening or cavity 44 extending therethrough and external threads 48 mating with the internal threads 26 of the barrel 20.

Figure 3:
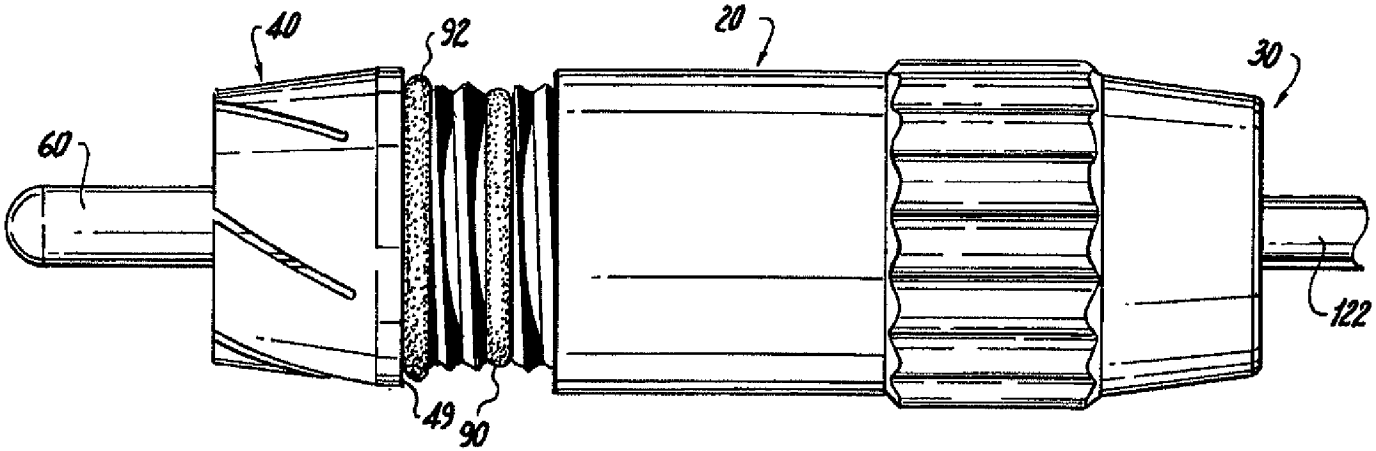
FIG. 3 is a side elevational view of the electrical connector show in FIGS. 1 and 2 at the beginning of being coupled and showing first and second indicator rings.
Figure 5:
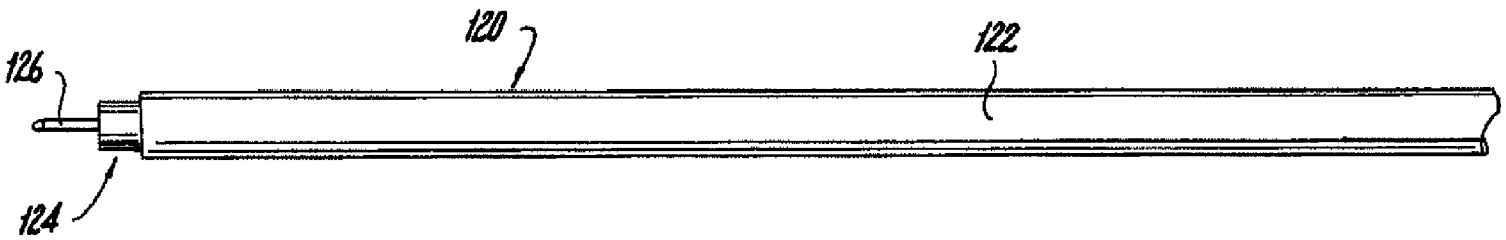
FIG. 5 is a side elevational view of the coaxial cable.

The connector 10 includes an electrically conductive elongated pin 60 positioned in the opening 44 of the front portion 40 and the cavity 24 of the barrel 20 when assembled as shown in FIG. 3. The pin 60 extends through a distal end of the front portion 40 when assembled as shown in FIG. 3. The pin 60 includes a back end 64 with a slit 65 for mating with an electrically conductive element embodied as a conductor 126 of a coaxial cable 120 (shown in FIG. 5). As shown in FIG. 5, the coaxial cable 120 includes an outer jacket 122 covering a braided portion 124 over the conductor 126. Other embodiments of a conductive wire may include, for example, power cables, and other electrical wiring such as used in building wiring.

The connector 10 further includes, a grasping device embodied as a resilient plastic inner grasping ring 50 which defines an aperture 54 therethrough having a specified diameter. The diameter of the aperture 54 can be specified to accommodate varies size cables. The grasping ring 50 is disposed within the cavity 24 of the barrel 20 such that opening 44 of the front portion 40 and aperture 54 of the grasping ring 50 aligns with the hole 28 in the back wall 30 of the barrel 20. The grasping ring 50 further includes slits 58 which allow the grasping ring 50 to compress and narrow the aperture 54 for gripping a cable. The grasping ring is made of a resilient material such as plastic, so that it returns to its at rest position once uncompressed. The grasping ring 50 may also be made of other resilient materials.

Figure 7:
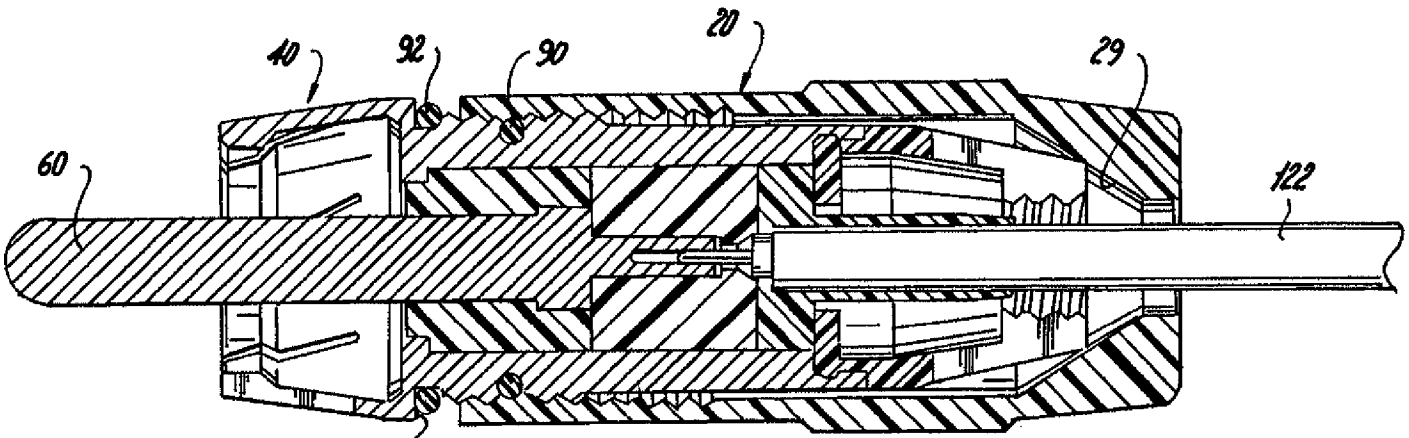
FIG. 7 is a cross sectional side elevational view of the electrical connector shown in FIG. 6 with the pin seated in its final position and the grasping ring engaged with the inner angled walls of the barrel portion.

The grasping ring 50 has a disengaged position from a cable when the barrel 20 and the front portion 40 are uncoupled, and the grasping ring 50 has an engaged position, while gripping the cable, when the barrel 20 and the front portion 40 are coupled for holding, for example, the coaxial cable 120 positioned within the aperture 54. Thereby, the aperture 54 in the grasping ring 50 has an at-rest diameter and a second diameter when the grasping ring 50 is engaged with the barrel 20 for gripping the coaxial cable 120. The grasping ring 50 also includes ridges 55 (FIG. 2) for gripping more securely the coaxial cable 120 when the grasping ring 50 is in the engaged position (FIG. 7).

Additionally, the connector according to the embodiment of the present invention shown in FIGS. 1 and 2 includes front and back insulator elements 70, 72, respectively, composed of a dielectric material, for example, hard plastic. Both of the insulator elements 70, 72 provide insulation for the conductive pin 60, ensuring an electronic signal flowing through the pin 60 connected to the coaxial cable 120. When the connector is assembled, the back insulator element 72 receives the conductor 126 and the braid portion 124 of the coaxial cable 120 in a hole 73 passing through the element 72 while the jacket 122 abuts the back insulator element 72. The pin 60 passes through a hole 71 in the front insulator element 70 and extends through the opening 44 in the front portion 40 when the connector is assembled. Additionally, the connector 10 includes a receiving element 80 with a opening 82 passing therethrough. The receiving element 80 receives the braid 124 and the conductor 126 for seating the back end 64 of the pin 60 to the coaxial cable 120 as the connector 10 is assembled, as show in FIGS. 4 and 6.

Referring to FIG. 2 the front portion 40 further includes a ridge 46 which mates with a lip 59 at the distal end of the grasping ring 50. The lip 59 flexibly snaps over the ridge 46, which holds the grasping ring 50 and the front portion 40 together. The mating lip 59 and ridge 46 allows the grasping ring 50 to rotate fully (360°) while securing the grasping ring 50 to the front portion 40. Thus, when disassembling the connector 10, and removing the coaxial cable 120 from the connector 10, the grasping ring 50 will not be removed with the coaxial cable 120.

Referring to FIGS. 1-3, a first indicator embodied as a first indicator ring 90 visually indicates the beginning of contact between the conductor 126 and the back end 64 of the pin 60. A second indicator embodied as a second indicator ring 92, visually indicates that the connecter is fully assembled when the barrel 20 slips over the second indicator ring 92 and contacts a rim 49 of the front portion 40.

Figure 4:
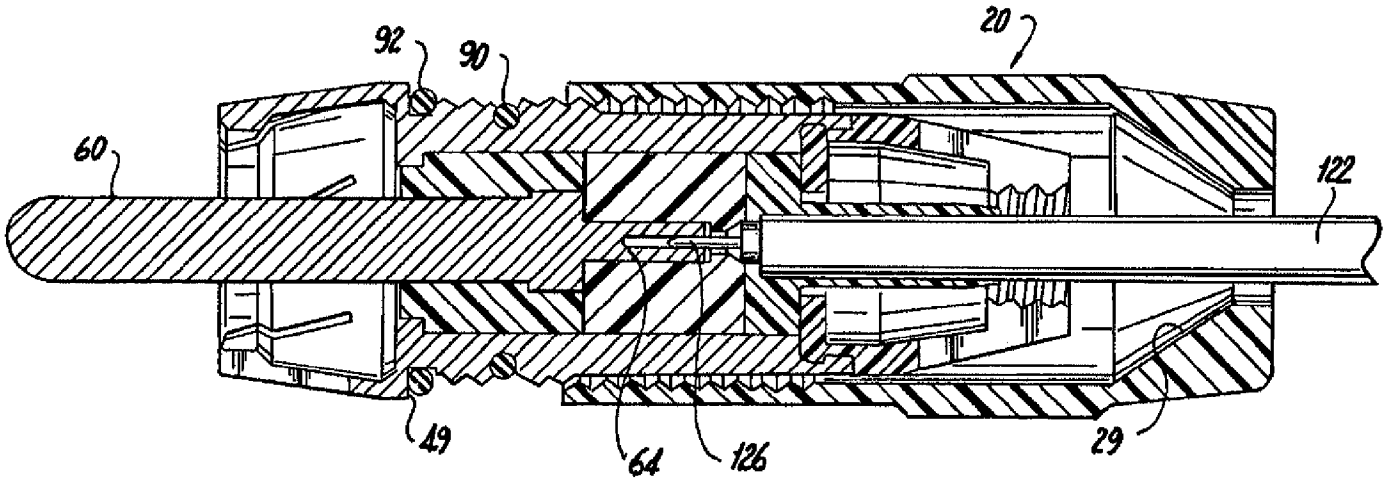
FIG. 4 is a cross sectional side elevational view of the electrical connector shown in FIG. 3 with a coaxial cable coupled to the pin and wherein the first indicator ring indicates the grasping ring beginning to grip the coaxial cable.
Figure 6:
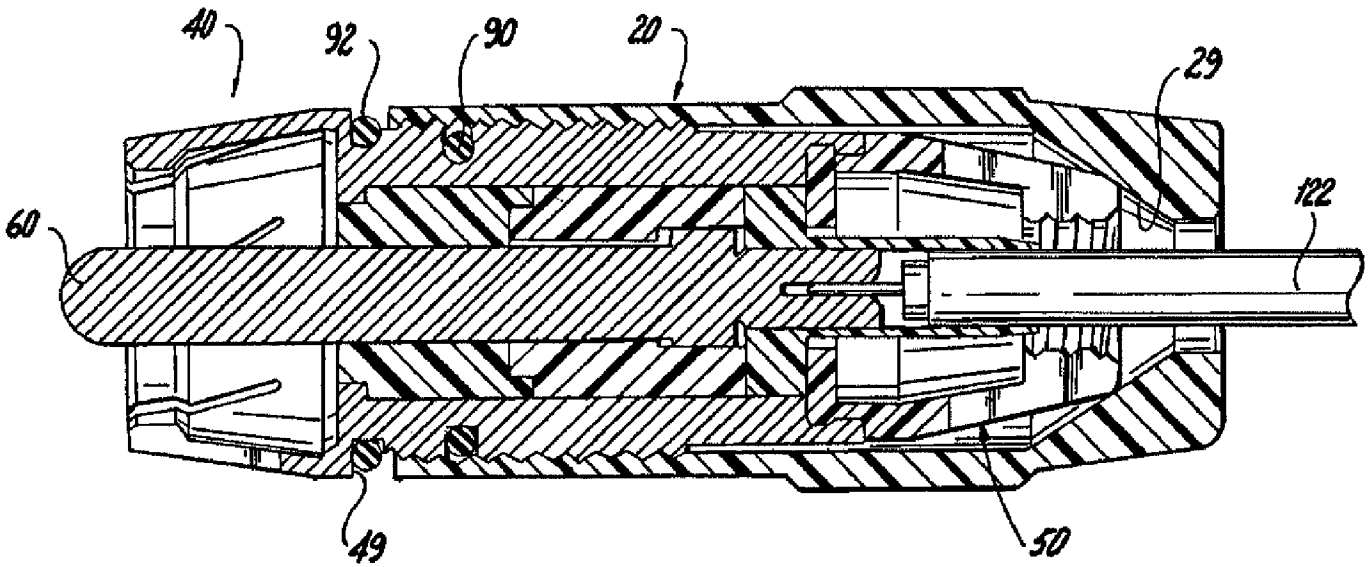
FIG. 6 is a cross sectional side elevational view of the electrical connector shown in FIG. 4 with the pin advancing toward the back of the barrel portion and the grasping ring engaged with inner angled walls of the barrel portion.

In operation, as the connector 10 is assembled, referring to FIGS. 3-5, the conductor 126 is coupled to the back end 64 of the pin 60. A user manually couples the pin 60 and the conductor 126 by simultaneously holding the pin 60 and the coaxial cable 120 while aligning the conductor 126 and the back end 64 of the pin 60 inside the connector 10. The user feels the contact between the coaxial cable 120 and the pin 60, as shown in FIG. 4, and moves the pin 60 into a seated position within the connector as shown in FIG. 6, and then pushes the coaxial cable 120 further into the opening 30 of the barrel 20 to the final position of the pin 60 show in FIG. 7. Further, as the connector 10 is beginning to be assembled, the first indicator ring 90 visually indicates the beginning of contact between the conductor 126 and the back end 64 of the pin 60. Contrarily, when disassembling the connector 10, the first ring 90 becomes visible when the back end 64 of the pin 60 disengages from the conductor 126 providing a visual indication that the conductor 126 and the pin 60 are disengaged.

Figure 8:
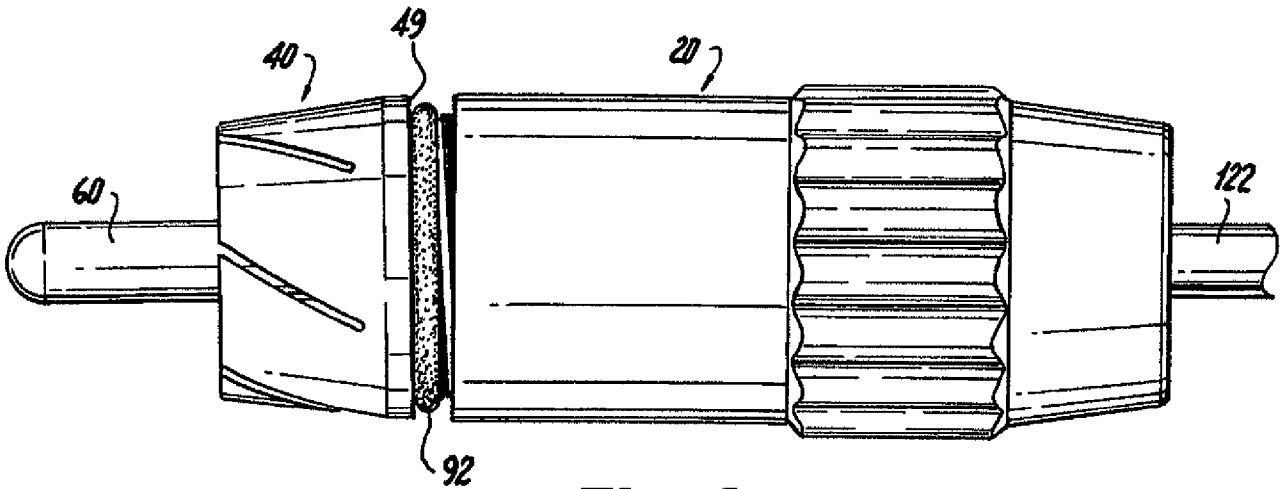
FIG. 8 is a side elevational view of the electrical connector being nearly completely coupled and showing the second indicator ring.

As the connector is assembled, the grasping ring 50 contacts the angled inner wall 29 of the barrel 20, as shown in FIGS. 6 and 7. As the connector 10 is fully assembled by screwing the barrel 20 to the front portion 40, the angled inner wall 29 forces the grasping ring 50 to compress. The slits 58 allow the ring 50 to compress into an engaged position wherein the aperture 54 of the grasping ring 50 narrows and the ridges 55 of the grasping ring 50 grip the outer jacket 122 of the coaxial cable 120 in concert with the grasping ring 50 moving against the angled wall 29. The second indicator ring 92 visually indicates that the connecter is fully assembled when barrel 20 slips over the second indicator ring 92 and contacts the rim 49 of the front portion 40, as shown in FIG. 8. Contrarily, when disassembling the connector 10, the second indicator ring 92 visual indicates that the connector 10 is not fully assembled.

Thereby, the connector 10 removably attaches the pin 60 and the coaxial cable 120 without a separate tool, and thus is a tool-less compression connector. An additional advantage of the connector 10 according to the present invention is that the connector 10 is reusable. The present invention embodied as the connector 10 provides an assembly and method for removably attaching the pin 60 to the coaxial cable 120 by assembling the connector 10, removing the pin 60 from the coaxial cable 120 by disassembling the connector 10, and optionally reusing the connector 10.

While the present invention has been particularly shown and described with respect to preferred embodiments thereof it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. An electrical connector, comprising:

a rear portion defining a cavity therein, the rear portion having a rear opening and a front opening communicating with the cavity;

a front portion configured to removably mate with the rear portion, the front portion defining a cavity having a rear opening and a front opening communicating with the cavity opening, the front and rear portions having a closed position and an open position;

an electrically conductive elongated pin moveably positioned in the cavity of the front portion and the cavity of the rear portion, the pin extending through the front opening of the front portion, the pin including a back end for mating with an electrically conductive element; and a grasping device defining an aperture therethrough having a diameter, the grasping device being disposed within the cavity of the rear portion and the cavity of the front portion, the grasping device coupled to the front portion adjacent the rear opening in the front portion, the grasping device being engaged for gripping the electrically conductive element positioned within the front portion cavity and the rear portion cavity when the rear portion and the front portion are in the closed position, and the grasping device being disengaged for releasing the electrically conductive element when the rear portion and the front portion are in the open position.

2. The connector of claim 1, wherein when the rear and front portions are closed, the engaged grasping device contacts the rear portion for narrowing the aperture in the grasping device.

3. The connector of claim 2, wherein the aperture in the grasping device has an at-rest diameter when the grasping device is disengaged, and a second diameter when the grasping device is engaged.

4. The connector of claim 2, wherein the electrically conductive element is passed through the rear and front openings of the rear portion and the aperture in the grasping device, and the grasping device resiliently grips the electrically conductive element when the rear portion and the front portion are closed, and the grasping device releases the electrically conductive element when the rear portion and the front portion are opened.

5. The connector of claim 1, wherein the grasping device is resiliently flexible.

6. The connector of claim 1, wherein the grasping device is resiliently compressed when contacting the rear portion for narrowing the aperture in the grasping device when the rear and front portions are in the closed position.

7. The connector of claim 6, wherein the grasping device is plastic.

8. The connector of claim 1, wherein the grasping device is resiliently compressed when contacting an angled inner wall of the rear portion narrowing the aperture in the grasping device when the rear and front portions are in the closed position.

9. The connector of claim 1, wherein the grasping device defines slits allowing the grasping device to be resiliently compressed when contacting the rear portion.

10. The connector of claim 1, wherein the electrically conductive elongated pin includes a recessed area at the back end for mating with the electrically conductive element.

11. The connector of claim 1, wherein the grasping device includes ridges for holding an electrical cable in the aperture when the grasping device is engaged.

12. The connector of claim 1, wherein the rear portion includes internal threads mating with external threads on the front portion.

13. The connector of claim 1, wherein the pin is moveable within the cavity of the front portion and the cavity of the rear portion to moveably mate with the electrically conductive element.

14. The connector of claim 1, wherein the pin is movable within the cavities of the front and rear portions and reciprocates motion with the electrical conductive element mating with the pin.

15. The connector of claim 1, wherein the grasping device is a resilient plastic ring defining slits allowing compression of the ring, and the ring returning to its original state when uncompressed.

16. The connector of claim 1, further including:

a first indicator viewable from the outside of the front portion for indicating when the grasping device is in the disengaged position.

17. The connector of claim 1, further including:

a second indicator viewable from the outside of the front portion for indicating when the front and rear portions are not closed.

18. The connector of claim 1, wherein the grasping device incrementally grips the electrically conductive element as the front and rear portions move from the open position to the closed position.

19. A method for connecting electrical elements, comprising:

providing a rear portion defining a cavity therein, the rear portion having a rear opening and a front opening communicating with the cavity;

providing a front portion configured to removably mate with the rear portion, the front portion defining a cavity having a rear opening and a front opening communicating with the cavity opening;

positioning an electrically conductive elongated pin in the cavity of the front portion and the cavity of the rear portion, the pin extending through the front portion;

coupling a back end of the pin with an electrically conductive element;

providing a grasping device defining an aperture therethrough having a diameter;

positioning the grasping device within the cavity of the rear portion and the cavity of the front portion;

closing the rear portion and the front portion for moving the grasping device into an engaged position for gripping the electrically conductive element positioned within the front portion cavity and the rear portion cavity; and opening the rear portion and the front portion for moving the grasping device into a disengaged position for releasing the electrically conductive element positioned within the front portion cavity and the rear portion cavity.

20. The method of claim 19, further including:

the grasping device contacting an angled inner wall of the rear portion for incrementally compressing the grasping device as the rear portion and the front portion are closed.

* * * * *